US011239578B2

(12) United States Patent
Tada et al.

(10) Patent No.: US 11,239,578 B2
(45) Date of Patent: Feb. 1, 2022

(54) CONNECTOR AND ELECTRONIC DEVICE SYSTEM

(71) Applicant: Mitsubishi Electric Corporation, Tokyo (JP)

(72) Inventors: Keisuke Tada, Tokyo (JP); Yoshinao Tatei, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/252,749

(22) PCT Filed: Jun. 28, 2018

(86) PCT No.: PCT/JP2018/024603
§ 371 (c)(1),
(2) Date: Dec. 16, 2020

(87) PCT Pub. No.: WO2020/003441
PCT Pub. Date: Jan. 2, 2020

(65) Prior Publication Data

US 2021/0257756 A1 Aug. 19, 2021

(51) Int. Cl.
*H01R 13/10* (2006.01)
*H01R 9/24* (2006.01)
(Continued)

(52) U.S. Cl.
CPC ..... *H01R 9/24* (2013.01); *H01R 13/04* (2013.01); *H01R 13/10* (2013.01); *H01R 13/502* (2013.01)

(58) Field of Classification Search
CPC ..... H01R 9/24; H01R 13/10; H01R 13/04; H01R 13/502
See application file for complete search history.

(56) References Cited

U.S. PATENT DOCUMENTS 4,820,200 A * 4/1989 Lau ..... H01R 24/58 439/607.34
5,277,606 A 1/1994 Giroux et al.
(Continued)

FOREIGN PATENT DOCUMENTS

DE 112013005868 T5 8/2015
JP 55-151086 U 10/1980
(Continued)

OTHER PUBLICATIONS

International Search Report and Written Opinion dated Aug. 21, 2018, received for PCT Application PCT/JP2018/024603, Filed on Jun. 28, 2018, 10 pages including English Translation.
(Continued)

*Primary Examiner* — Abdullah A Riyami
*Assistant Examiner* — Nelson R. Burgos-Guntin
(74) *Attorney, Agent, or Firm* — Xsensus LLP

(57) ABSTRACT

A connector includes a first housing and a second housing. The connector includes a terminal that is a first terminal disposed in a region opposite to the electronic device, of the second housing, and a terminal that is a second terminal disposed in the region opposite to the electronic device, of the second housing, and disposed adjacent to the first terminal. The connector includes a terminal that is a third terminal disposed in the region opposite to the electronic device, of the second housing, and disposed adjacent to the second terminal along an arrangement direction of the first terminal and the second terminal. The connector includes a first connecting conductor that electrically connects together the first terminal and the second terminal, and electrically connects the first terminal and the second terminal to a first device-side conductor provided in the electronic device.

8 Claims, 6 Drawing Sheets

(51) Int. Cl.
*H01R 13/04* (2006.01)
*H01R 13/502* (2006.01)

(56) References Cited

U.S. PATENT DOCUMENTS

| | | | | |
|---|---|---|---|---|
| 5,493,194 | A * | 2/1996 | Damiano | H05K 7/1484 318/575 |
| 5,645,455 | A | 7/1997 | Seki | |
| 6,755,664 | B2 | 6/2004 | Sakamoto et al. | |
| 8,172,589 | B2 * | 5/2012 | Johnson | H02G 3/38 439/215 |
| 8,876,548 | B2 * | 11/2014 | Doorhy | H01R 25/006 439/535 |
| 2004/0198090 | A1 * | 10/2004 | Morizaki | H01R 12/675 439/387 |
| 2006/0286839 | A1 * | 12/2006 | Bethurum | H01R 4/4818 439/188 |
| 2007/0123075 | A1 * | 5/2007 | Insalaco | H02G 3/388 439/120 |
| 2009/0149048 | A1 * | 6/2009 | Pavlovic | B60L 3/0069 439/181 |
| 2015/0044910 | A1 * | 2/2015 | Lisbona | H01H 71/123 439/620.21 |
| 2020/0194949 | A1 * | 6/2020 | Egawa | H01R 13/4364 |

FOREIGN PATENT DOCUMENTS

| | | | |
|---|---|---|---|
| JP | 55-160088 | U | 11/1980 |
| JP | 56-115878 | U | 9/1981 |
| JP | 6-223903 | A | 8/1994 |
| JP | H07-263096 | A | 10/1995 |
| JP | 9-115611 | A | 5/1997 |
| JP | 2000-286027 | A | 10/2000 |
| JP | 2003-272783 | A | 9/2003 |
| JP | 2005-340097 | A | 12/2005 |
| WO | 2014/086937 | A1 | 6/2014 |

OTHER PUBLICATIONS

"Terminal Block/Connector for Printed Circuit Board", Phoenix Contact, (2017-2018), 10 pages including English Translation.

Notification of Reasons for Refusal dated Jan. 29, 2019, received for JP Application 2018-566611, 6 pages including English Translation.

Decision to Grant dated Apr. 9, 2019, received for JP Application 2018-566611, 5 pages including English Translation.

Office Action dated Aug. 27, 2021, in corresponding German patent Application No. 112018007682.2, 32 pages.

* cited by examiner

CONNECTOR AND ELECTRONIC DEVICE SYSTEM

CROSS-REFERENCE TO RELATED APPLICATION

The present application is based on PCT filing PCT/JP2018/024603, filed Jun. 28, 2018, the entire contents of which are incorporated herein by reference.

FIELD

The present invention relates to a connector to be provided for an electronic device, and to an electronic device system including multiple electronic devices each of which is provided with such a connector.

BACKGROUND

In an electronic device system having multiple electronic devices set therein, the device being arranged adjacent to each other, device-side conductors provided in the adjacent electronic devices, respectively, are connected to each other in daisy chain configuration using transition wiring lines when the multiple electronic devices commonly use a same type of signal. Such a method for electronic device connection is called as daisy chain connection. When multiple electronic devices are connected in a daisy chain configuration, it is a typical practice to provide a connector for transition wiring in each of the multiple electronic devices so as to allow easy connection of a transition wiring line to a device-side conductor and easy removal of the transition wiring line connected with the device-side conductor.

The connector for transition wiring disclosed in Non Patent Literature 1 includes a housing, and first to fourth terminals disposed in a region on the side opposite to a region facing an electronic device in this housing. The second terminal is disposed adjacent to the first terminal. The third terminal is disposed adjacent to the first terminal along a direction perpendicular to the arrangement direction of the first terminal and the second terminal. The fourth terminal is disposed adjacent to the second terminal and the third terminal along the perpendicular direction.

The housing also includes a connecting conductor. The connecting conductor is a conductor electrically connecting together the first terminal and the second terminal, and electrically connecting the first terminal and the second terminal to the device-side conductor provided in an electronic device. The connecting conductor has a bifurcated shape at an end of one conductor extending from the device-side conductor to the first terminal and the second terminal.

Connection of a first transition wiring line to the first terminal and connection of the first transition wiring line to the second terminal causes the first transition wiring line and the second transition wiring line to be electrically connected to each other by the connecting conductor.

CITATION LIST

Non Patent Literature

Non-patent Literature 1: Phoenix Contact, Product catalog "PCB terminal blocks and connectors", 2017/2018, Internet<URL: https://www.phoenixcontact.com/assets/downloads_ed/global/web_dwl_promotion/CAT_7_2017_JA_LoRes.pdf>P349 TSPC 5/..-/STseries

SUMMARY

Technical Problem

However, when the connector of Non-patent Literature 1 is used in an electronic device, multiple terminals are provided in arrangement of a two-row by two-column matrix in a housing when the first through fourth terminals are planarly viewed from the connector toward the electronic device. Thus, the first terminal and the second terminal connected to each other by a connecting conductor are arranged along the arrangement direction of the multiple electronic devices, and the width of the housing in the arrangement direction is relatively greater than the width of the electronic devices in the arrangement direction. Accordingly, an end of the housing in the arrangement direction protrudes into a gap between two adjacent electronic devices, which may then cause the housing of the connector disposed in an electronic device to interfere with another electronic device adjacent to that electronic device. In order to prevent such interference, the gap has to be widened, and so this widening of the gap leads to increase in size of the entire electronic device system including the gap, which have caused a problem.

The present invention has been made in view of the above circumstances, and its object is to provide a connector that enables a reduction in size of the entire electronic device system including multiple electronic devices.

Solution to Problem

In order to solve the above-mentioned problem and achieve the object, the present invention provides a connector comprising: a first housing to be attached to an electronic device; a second housing attached to the first housing on a side opposite the electronic device; a first terminal disposed in a region located on a side to opposite a region facing the electronic device, of the second housing; a second terminal disposed in the region located on the opposite side and disposed adjacent to the first terminal; a third terminal disposed in the region located on the opposite side and disposed adjacent to the second terminal along an arrangement direction of the first terminal and the second terminal; and a first connecting conductor to electrically connect together the first terminal and the second terminal, and electrically connect the first terminal and the second terminal to first device-side conductor provided in the electronic device.

Advantageous Effects of Invention

A connector according to the present invention provides an advantageous effect of enabling a reduction in the size of the entire electronic device system including multiple electronic devices.

DESCRIPTION OF EMBODIMENT

A connector and an electronic device system according to an embodiment of the present invention will be described in detail below with reference to the drawings. Note that this embodiment is not intended to limit the scope of this invention.

Embodiment

Figure 1:
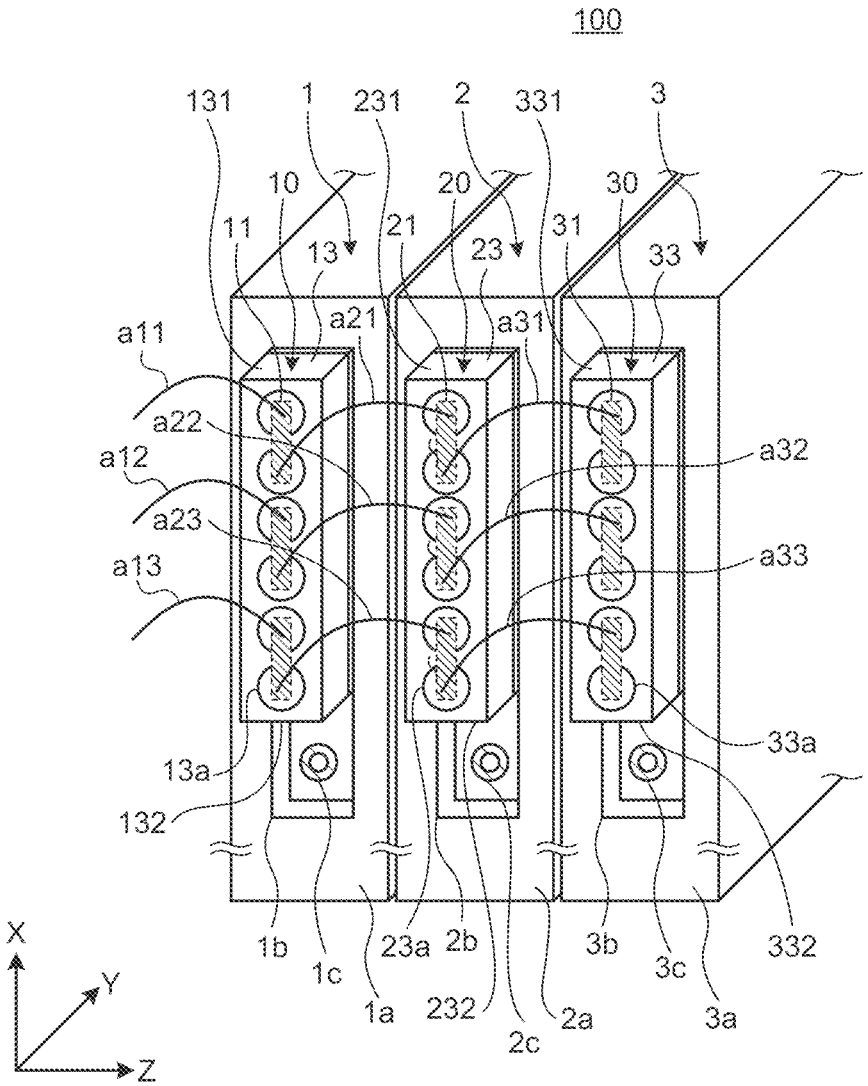
FIG. 1 is an external view of an electronic device system according to an embodiment of the present invention.
Figure 2:
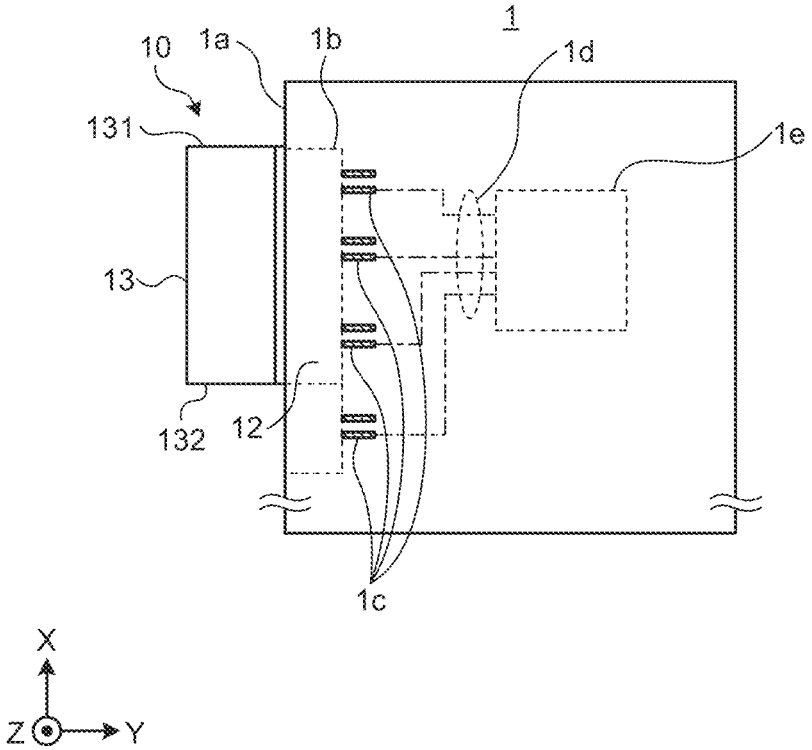
FIG. 2 is a diagram illustrating the inside of an electronic device illustrated in FIG. 1.

FIG. 1 is an external view of an electronic device system according to an embodiment of the present invention FIG. 2 is a diagram illustrating the inside of an electronic device illustrated in FIG. 1. FIG. 2 illustrates an electronic device 1 of multiple electronic devices 1 to 3 illustrated in FIG. 1 and a connector 10 connected to the electronic device 1.

An electronic device system 100 illustrated in FIG. 1 includes multiple electronic devices 1, 2, and 3, a connector 10 provided in the electronic device 1, a connector 20 provided in the electronic device 2, a connector 30 provided in the electronic device 3, three transition wiring lines a11, a12, and a13, three transition wiring lines a21, a22, and a23, and three transition wiring lines a31, a32, and a33. The electronic device 1 is a first electronic device, and the electronic device 1 is provided with the connector 10 as a first connector. The electronic device 2 is a second electronic device, and the electronic device 2 is provided with the connector 20 as a second connector. The electronic device 3 is a third electronic device, and the electronic device 3 is provided with the connector 30 as a third connector. The electronic device 2 is disposed adjacent to the electronic device 1, and the electronic device 3 is disposed on the side of the electronic device 2 opposite to the first electronic device.

The multiple electronic devices 1, 2, and 3 are each, for example, an inverter for driving a motor, a servo amplifier for controlling a servomotor, or the like. Note that although this embodiment assumes three electronic devices, it is sufficient that at least two electronic devices are connected to each other using a transition wiring line, and that the number of the electronic devices is two or greater.

In FIG. 1, the lateral width direction of the multiple electronic devices 1, 2, and 3 is regarded as a Z-axis direction, the depth direction of the multiple electronic devices 1, 2, and 3 is regarded as a Y-axis direction, and the longitudinal width direction of the multiple electronic devices 1, 2, and 3 is regarded as an X-axis direction, in a left-handed XYZ coordinate system. The Z-axis direction corresponds to the arrangement direction of the multiple electronic devices 1, 2, and 3. The above-mentioned axial directions also apply to the drawings of FIG. 2 and the later figures.

Each of the three transition wiring lines a11, a12, and a13 connects, for example, a device that generates a signal used in common by the multiple electronic devices 1, 2, and 3 to the connector 10.

Each of the three transition wiring lines a21, a22, and a23 connects the connector 10 to the connector 20.

Each of the three transition wiring lines a31, a32, and a33 connects the connector 20 to the connector 30.

The connector 10 provided in the electronic device 1 includes a first housing 12 to be inserted in a connector insertion opening 1*b* formed one end face 1*a* of the electronic device 1 in the Y-axis direction, and a second housing 13 disposed on the side opposite to the electronic device 1, of the first housing 12. The first housing 12 and the second housing 13 together constitute an enclosure of the connector 10, and are attached to the electronic device 1.

The connector insertion opening 1*b* is a recess sinking in the Y-axis direction from the end face 1*a* of the electronic device 1. The connector insertion opening 1*b* is provided with multiple device-side conductors 1*c*. Each of the multiple device-side conductors 1*c* is, for example, an electrically conductive 1 and on a printed board provided in the electronic device 1. Note that the device-side conductor 1*c* is not limited to a land, but may be a cylindrical electrically conductive through-hole formed in a printed board.

Multiple terminal insertion holes 13*a*1, 13*a*2, 13*a*3, 13*a*4, 13*a*5, and, 13*a*6 linearly arranged in the X-axis direction are formed in the second housing 13. The multiple terminal insertion holes 13*a*1, 13*a*2, 13*a*3, 13*a*4, 13*a*5, and 13*a*6 may hereinafter be referred to simply as terminal insertion hole 13*a*. The multiple terminal insertion holes 13*a* are arranged spaced apart from each other in the X-axis direction.

In the first terminal insertion hole 13*a*1 as viewed in a direction from a first end face 131 of the second housing 13 to a second end face 132 of the same, a male terminal is inserted, the male terminal being provided on one end of the first transition wiring line a11 as viewed in a direction from the first end face 131 of the second housing 13 to the second end face 132 of the same.

Similarly, in the second terminal insertion hole 13*a*2, another male terminal is inserted, the male terminal being provided on one end of the first transition wiring line a21, and in the third terminal insertion hole 13*a*3, a further male terminal is inserted, the male terminal being provided on one end of the second transition wiring line a12.

In addition, in the fourth terminal insertion hole 13*a*4, a male terminal provided on one end of the second transition wiring line a22 is inserted, in the fifth terminal insertion hole 13*a*5, a male terminal provided on one end of the third transition wiring line a13 is inserted, and in the sixth terminal insertion hole 13*a*6, a male terminal provided on one end of the third transition wiring line a23 is inserted.

The connector 10 has multiple conductors 11. The multiple conductors 11 are disposed in the second housing 13. The multiple conductors 11 are arranged spaced apart from each other in the X-axis direction. The first conductor 11 as viewed in a direction from the first end face 131 to the second end face 132 of the second housing 13 extends in the X-axis direction with passing from the first terminal insertion hole 13*a*1 to the second terminal insertion hole 13*a*2 as viewed in a direction from the first end face 131 to the second end face 132 of the second housing 13.

Note that FIG. 1 illustrates the conductors 11 for convenience of illustration, but the conductors 11 are, in fact, disposed inside the second housing 13, and are therefore invisible from outside of the second housing 13.

The second conductor 11 extends in the X-axis direction with passing from the third terminal insertion hole 13*a*3 to the fourth terminal insertion hole 13*a*4. The third conductor 11 extends in the X-axis direction with passing from the fifth terminal insertion hole 13*a*5 to the sixth terminal insertion hole 13*a*6.

The connector 20 provided in the electronic device 2 includes, similarly to the connector 10, a first housing inserted in a connector insertion opening 2*b* of the electronic device 2, a second housing 23 disposed on the side opposite to the electronic device 2 of the first housing, and multiple conductors 21 disposed in the second housing 23. FIG. 1 omits illustration of the first housing provided in the connector 20. Note that FIG. 1 illustrates the conductors 21 for convenience of illustration, but the conductors 21 are, in fact, disposed inside the second housing 23, and are therefore invisible from outside of the second housing 23.

The connector insertion opening 2*b* is formed on an end face 2*a* of the electronic device 2 in the Y-axis direction. The connector insertion opening 2*b* is provided with device-side conductors 2*c* that are terminals equal to the device-side conductors 1*c*.

Multiple terminal insertion holes 23*a* linearly arranged in the K-axis direction are formed in the second housing 23 similarly to the second housing 13. The multiple terminal insertion holes 23*a* are arranged spaced apart from each other in the K-axis direction. In the first terminal insertion hole 23*a* as viewed from a first end face 231 to a second end face 232 of the second housing 23, a male terminal is inserted, which is provided on another end of the first transition wiring line a21 as viewed from the first end face 231 to the second end face 232 of the second housing 23.

Similarly, in the second terminal insertion hole 23*a*, a male terminal is inserted, which is provided on one end of the first transition wiring line a31. In the third terminal insertion hole 23*a*, a male terminal is inserted, which is provided on another end of the second transition wiring line a22.

In addition, in the fourth terminal insertion hole 23*a*, a male terminal is inserted, which is provided on one end of the second transition wiring line a32. In the fifth terminal insertion hole 23*a*, a male terminal is inserted, which is provided on another end of the third transition wiring line a23. In the sixth terminal insertion hole 23*a*, a male terminal is inserted, which is provided on one end of the third transition wiring line a33.

The multiple conductors 21 are arranged spaced apart from each other in the X-axis direction. The first conductor 21 as viewed from the first end face 231 to the second end face 232 of the second housing 23 extends in the X-axis direction with passing from the first terminal insertion hole 23*a* to the second terminal insertion hole 23*a* as viewed in the direction from the first end face 231 to the second end face 232 of the second housing 23. Similarly, the second conductor 21 extends in the X-axis direction with passing from the third terminal insertion hole 23*a* to the fourth terminal insertion hole 23*a*, and the third conductor 21 extends in the X-axis direction with passing from the fifth terminal insertion hole 23*a* to the sixth terminal insertion hole 23*a*.

The connector 30 provided in the electronic device 3 includes, similarly to the connector 10, a first housing inserted in a connector insertion opening 3*b* of the electronic device 3, a second housing 33 disposed on the side opposite to the electronic device 3 of that first housing, and multiple conductors 31 disposed in the second housing 33. FIG. 1 omits illustration of the first housing included in the connector 30. Note that FIG. 1 illustrates the conductors 31 for convenience of illustration, but the conductors 31 are, in fact, disposed inside the second housing 33, and are therefore invisible from outside of the second housing 33.

The connector insertion opening 3*b* is formed on an end face 3*a* of the electronic device 3 in the Y-axis direction. The connector insertion opening 3*b* is provided with device-side conductors 3*c* that are terminals equal to the device-side conductors 1*c*.

Multiple terminal insertion holes 33*a* linearly arranged in the X-axis direction are formed in the second housing 33 similarly to the second housing 13. The multiple terminal insertion holes 33*a* are arranged spaced apart from each other in the X-axis direction. In the first terminal insertion hole 33*a* as viewed from a first end face 331 to a second end face 332 of the second housing 33, a male terminal is inserted, which is provided on another end of the first transition wiring line a31 as viewed from the first end face 331 to the second end face 332 of the second housing 33.

Similarly, in the third terminal insertion hole 33*a*, a male terminal is inserted, which is provided on another end of the second transition wiring line a32, and in the fifth terminal insertion hole 33*a*, a male terminal is inserted, which is provided on another end of the third transition wiring line a33.

The multiple conductors 31 are arranged spaced apart from each other in the X-axis direction. The first conductor 31 as viewed from the first end face 331 to the second end face 332 of the second housing 33 extends in the X-axis direction with passing from the first terminal insertion hole 33*a* to the second terminal insertion hole 33*a* as viewed in the direction from the first end face 331 to the second end face 332 of the second housing 33. Similarly, the second conductor 31 extends in the X-axis direction with passing from the third terminal insertion hole 33*a* to the fourth terminal insertion hole 33*a*, and the third conductor 31 extends in the X-axis direction with passing from the fifth terminal insertion hole 33*a* to the sixth terminal insertion hole 33*a*.

As illustrated in FIG. 2, the multiple device-side conductors 1*c* provided in the connector insertion opening 1*b* are arranged spaced apart from each other in the X-axis direction. Among the multiple device-side conductors 1*c*, the first device-side conductor 1*c* as viewed from the first end face 131 to the second end face 132 of the second housing 13 is a first device-side conductor, and the second device-side conductor 1*c* as viewed from the first end face 131 to the second end face 132 of the second housing 13 is a second device-side conductor.

Each of the multiple device-side conductors 1*c* is electrically connected to an internal circuit 1*e* of the electronic device 1 via an internal wiring line 1*d* of the electronic device 1. Insertion of the connector 10 into the connector insertion opening 1*b* causes, for example, the transition wiring line a11 and the transition wiring line a21 illustrated in FIG. 1 to be electrically connected to the internal circuit 1*e* through the conductor 11 illustrated in FIG. 1 and the device-side conductor 1*c* illustrated in FIG. 2.

Note that the electronic device 2 illustrated in FIG. 1 includes internal wiring lines and an internal circuit similarly to the electronic device 1. Insertion of the connector 20 into the connector insertion opening 2*b* causes, for example, the transition wiring line a21 and the transition wiring line a31 to be electrically connected to the internal circuit of the electronic device 2 through the conductor 21 and the device-side conductor 2*c*. In addition, the electronic device 3 illustrated in FIG. 1 is provided with internal wiring lines and an internal circuit similarly to the electronic device 1. Insertion of the connector 30 into the connector insertion opening 3*b* causes, for example, the transition wiring line a31 to be electrically connected to the internal circuit of the electronic device 3 through the conductor 31 and the device-side conductor 3*c*.

As illustrated in FIG. 1, the electronic device 1, the electronic device 2, and the electronic device 3 are connected in a daisy chain configuration by using, for example, the first-order transition wiring line a11, transition wiring line a21, and transition wiring line a31, and the multiple connectors, i.e., the connector 10, the connector 20, and the connector 30.

In this regard, another end of the first transition wiring line a11 is connected to, for example, a device configured to generate a first signal used in common by the multiple electronic devices 1, 2, and 3. For example, in a case where the multiple electronic devices 1, 2, and 3 are each a servo amplifier, the device for generating the first signal is a programmable logic controller configured to control a motor connected to each servo amplifier, and the first signal is a control signal generated by the programmable logic controller. Otherwise, in a case where the multiple electronic devices 1, 2, and 3 are each an inverter, the device for generating the first signal is a control circuit for controlling operations of switching elements included in each inverter, and the first signal is a voltage command generated by the control circuit.

Note that the first signal only needs to be a signal used in common by the multiple electronic devices 1, 2, and 3, and the first signal is not limited to these kinds of signals mentioned above.

Another end of the second transition wiring line a12 may be connected to, for example, a device configured to generate a second signal different from the first signal used in common by the multiple electronic devices 1, 2, and 3. Similarly, another end of the third transition wiring line a13 may be connected to, for example, a device configured to generate a third signal different from the first signal used in common by the multiple electronic devices 1, 2, and 3 and from the second signal.

Besides, instead of wiring lines for signal transmission, for example, wiring lines extending from a direct current (DC) power supply that supplies DC power to the multiple electronic devices 1, 2, and 3 may be used for the multiple transition wiring lines a11, a12, and a13. Specifically, for example, the first transition wiring line a11 is used as a positive DC bus dine, the second transition wiring line a12 is used as a negative DC bus line, and the third transition wiring line a13 is used as a wiring line to transmit one of the first to third signals described above.

Note that although this embodiment assumes that the connectors each hare three connecting conductors provided therein, the number of the connecting conductors provided in each of the connectors is not limited to three. For example, in a case where the multiple electronic devices connected in a daisy chain configuration use two types of signals in common, the number of the connecting conductors included in each connector may be two. Alternatively, in a case where the multiple electronic devices connected in a daisy chain configuration use a single type of signal in common, the number of the connecting conductors provided in each connector may be one. Otherwise, in a case, where the multiple electronic devices connected in a daisy chain configuration use, in common, DC power supplied from a DC power supply, each connector may have provided therein two connecting conductors for a positive DC bus line and for a negative DC bus line.

A structure of the connector 10 will next be described in detail with reference to FIGS. 3 and 4. Note that since structures of the connector 20 and the connector 30 are similar to the structure of the connector 10, the following description will be given for the structure of the connector 10, and so description of the structures of the connector 20 and the connector 30 will be omitted.

Figure 3:
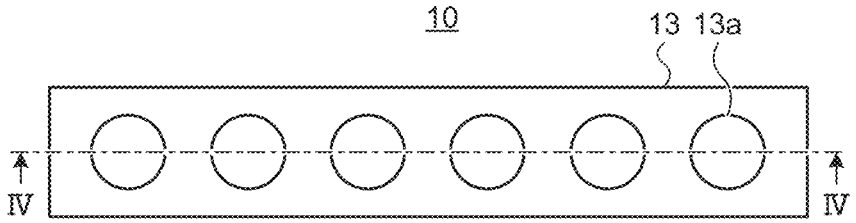
FIG. 3 is a front view of a connector illustrated in FIG. 1.

FIG. 3 is a front view of a connector illustrated in FIG. 1. FIG. 4 is an arrow-directional cross-sectional view taken along a line IV-IV illustrated in FIG. 3.

The first housing 12 of the connector 10 can be made of a material that is, by way of example, an electrically insulating resin such as polybutylene terephthalate, polyphenylene sulfide, or a liquid crystal polymer. A terminal 12*b* is made of a material that is, by way of example, electrically conductive iron, copper, ferrite, or the like.

The first housing 12 is provided with multiple terminals 12*b* arranged spaced apart from each other in the X-axis direction, and recesses 12*c* in each of which a protrusion 13*e* of the second housing 13 is inserted. The multiple terminals 12*b* are each an electrically conductive member having a column shape extending in the Y-axis direction. The first terminal 12*b* of the multiple terminals 12*b* as viewed from the first end face 131 to the second end face 132 of the second housing 13 is a first bar-shaped terminal. The second terminal 12*b* of the multiple terminals 12*b* as viewed from the first end face 131 to the second end face 132 of the second housing 13 is a second bar-shaped terminal. One end of the terminal 12*b* in the Y-axis direction is positioned in a space surrounded by a wall surface forming a through-hole 13*b*. Another end of the terminal 12*b* in the Y-axis direction extends toward a side opposite to the through-hole 13*b* and is positioned outside the first housing 12. The other end of each of the terminals 12*b* is soldered to the device-side conductor 1*c* illustrated in FIG. 2, for example. This mechanically and electrically connects the terminals 12*b* with the device-side conductors 1*c*.

The second housing 13 and the protrusions 13*e* of the connector 10 are made of a material that is, by way of example, an electrically insulating resin similar to the material of the first housing 12. The second housing 13 is manufactured using multiple members in combination, the members being produced by die-casting using an electrically insulating resin.

The second housing 13 includes the multiple protrusions 13*e* that each have a projecting shape, and are arranged spaced apart from each other in the X-axis direction and inserted in the respective recesses 12*c*; the multiple through-holes 13*b* that are formed in centers of the multiple protrusions 13*e*, respectively; and conductors 13*c* that are each a cylindrical terminal having a hollow-cylindrical shape provided on the inner circumference of the protrusion 13*e* to surround the through-hole 13*b*. In the connector 10 illustrated in FIG. 4, the conductors 13*c* are set on the first, third, and fifth protrusions 13*e*, respectively, as viewed from the first end face 131 to the second end face 132 of the second housing 13. Any conductors 13*c* are not provided on the second, fourth, and sixth protrusions 13*e*.

The second housing 13 also includes: multiple terminals 13*d*1, 13*d*2, 13*d*3, 13*d*4, 13*d*5, and 13*d*6 electrically connected to, for example, any of the three transition wiring lines a11, a21, and a31; and multiple conductors 11 each electrically connecting between two terminals 13*d* adjacent to each other in the X-axis direction. The multiple terminals 13*d*1, 13*d*2, 13*d*3, 13*d*4, 13*d*5, and 13*d*6 are disposed in a region opposite to the region facing the electronic device side in the housing that constitutes the enclosure of the connector 10. That is, the multiple terminals 13*d*1, 13*d*2, 13*d*3, 13*d*4, 13*d*5, and 13*d*6 are disposed on the side opposite to the first housing 12 side in the Y-axis direction in the second housing 13. The multiple terminals 13*d*1, 13*d*2, 13*d*3, 13*d*4, 13*d*5, and 13*d*6 may each hereinafter be referred to simply as terminals 13*d* in some cases.

The conductors 13*c*, the conductors 11, and the terminals 13*d* are made of, for example, a material that is similar to the material of the terminals 12*b*.

Figure 4:
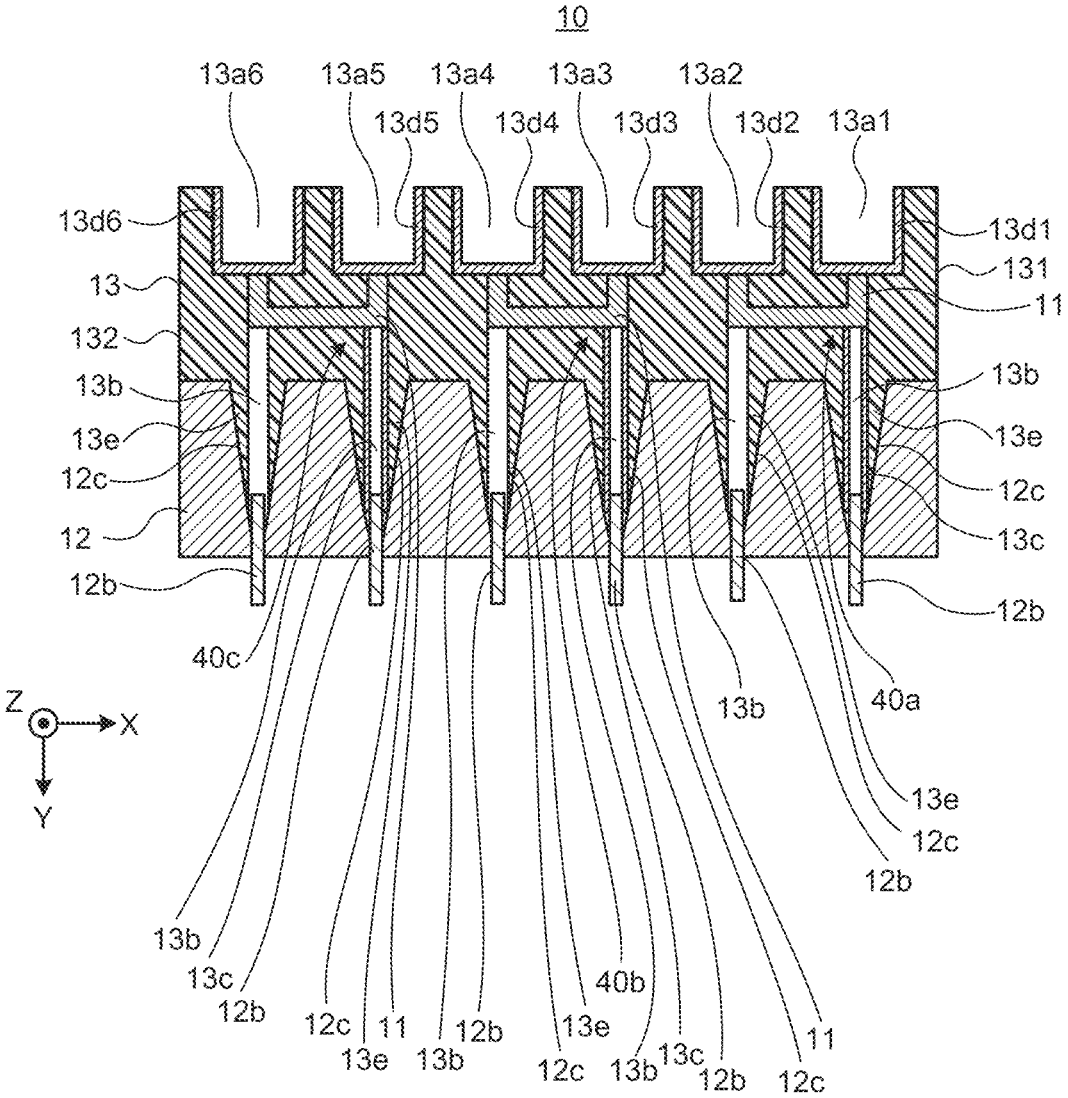
FIG. 4 is an arrow-directional cross-sectional view taken along a line IV-IV illustrated in FIG. 3.

In FIG. 4, as viewed in the direction from the first end face 131 to the second end face 132 of the second housing 13, the first terminal 13*d* is a first terminal, the second terminal 13*d* is a second terminal, the third terminal 13*d* is a third terminal, the fourth terminal 13*d* is a fourth terminal, the fifth terminal 13*d* is a fifth terminal, and the sixth terminal 13*d* is a sixth terminal.

The first terminal and the second terminal are connected with a single conductor 11. This single conductor 11 is connected with a single conductor 13*c*. The conductor 11 connecting together the first terminal and the second terminal, the conductor 13*c* connected to the conductor 11, and the terminal 12*b* connected to the conductor 13*c* constitute a first connecting conductor 40*a*. The terminal 12*b* has one end inserted in inside of the conductor 13*c*, thereby causing the terminal 12*b* to be mechanically and electrically connected to the conductor 13*c*.

The first connecting conductor 40*a* electrically connects together the first terminal and the second terminal, and electrically connects the first terminal and the second terminal to the first device-side conductor. The first connecting conductor 40*a* is a member having a bifurcated shape at an end of the conductor extending from the device-side conductor 1*c* illustrated in FIG. 2 toward the first terminal and the second terminal. The first connecting conductor 40*a* may be produced such that the conductor 11 and the conductor 13*c* are manufactured as a monolithic structure, or such that the conductor 11 and the conductor 13*c* are separately produced and then combined with each other. Note that it is sufficient that the end of the first connecting conductor 40*a* has a multi-branched form.

Similarly, the conductor 11 connecting the third terminal and the fourth terminal adjacent to each other, the conductor 13*c* connected to the conductor 11, and the terminal 12*b* connected to the conductor 13*c* constitute a second connecting conductor 40*b*. The second connecting conductor 40*b* electrically connects together the third terminal and the fourth terminal, and electrically connects the third terminal and the fourth terminal to the second device-side conductor.

Similarly, the conductor 11 connecting the fifth terminal and the sixth terminal adjacent to each other, the conductor 13*c* connected to the conductor 11, and the terminal 12*b* connected to the conductor 13*c* constitute a third connecting conductor 40*c*. The third connecting conductor 40*c* electrically connects together the fifth terminal and the sixth terminal, and electrically connects the fifth terminal and the sixth terminal to a third device-side conductor. The third device-side conductor corresponds, for example, to the third device-side conductor 1*c* of the multiple device-side conductors 1*c* illustrated in FIG. 2 as viewed from the first end face 131 to the second end face 132 of the second housing 13.

Fitting the second housing 13 into the first housing 12 causes the first terminal and the second terminal to be electrically connected to the first device-side conductor via the first connecting conductor 40*a*, and the third terminal and the fourth terminal to be electrically connected to the second device-side conductor via the second connecting conductor 40*b*. In addition, the fifth terminal and the sixth terminal are electrically connected to the third device-side conductor via the third connecting conductor 40*c*.

Note that, for example, in a case where the second housing 13 is constituted by a first member and a second member which are separable in the Z-axis direction, the first through third connecting conductors 40*a*, 40*b*, and 40*c* are attached to the second housing 13 in such a manner that the first through third connecting conductors 40*a*, 40*b*, and 40*c* are incorporated in the first member before the second member is combined with the first member, and then the second member is combined with the first member.

In addition, the first terminal, the second terminal, and the first connecting conductor 40*a* may be manufactured as a monolithic structure, or the first terminal, the second terminal, and the first connecting conductor 40*a* may be separately produced and then combined with each other. This also applies to the third terminal, the fourth terminal, and the second connecting conductor 40*b*. This also applies to the fifth terminal, the sixth terminal, and the third connecting conductor 40*c*.

When the connector 10 configured as described above is used in an electronic device, the second housing 13 is provided with the multiple terminals 13*d* linearly arranged along the X-axis direction when the multiple terminals 13*d* are planarly viewed from the connector 10 to the electronic device. This results in a reduced width of the second housing 13 in the Z-axis direction as compared to when the first terminal and the second terminal are arranged along the Z-axis direction.

Consequently, the second housing 13 does not protrude into the gap between the electronic device 1 and the electronic device 2 adjacent to each other, and therefore the possibility of interference of the connector 10 with the connector 20 is eliminated even if the gap is reduced. This also eliminates, for example, the possibility of interference of the second housing 13 of the connector 10 included in the electronic device 1 with the second electronic device. As the result, reduction can be achieved in the size of the entire electronic device system 100 including the gap.

Note that although the electronic device system 100 illustrated in FIG. 1 uses transition wiring lines to electrically connect together the multiple electronic devices, a member for electrically connecting the multiple electric devices may be an electrically conductive member by which electronic devices adjacent to each other of the multiple electronic devices are connected and tied in a row. This member may be, for example, a conductor having thereon an electrically-conductive patterned wiring line, an electrically conductive bus bar, or the like.

For example, the first terminal of the connector 20 included in the electronic device 2 illustrated in FIG. 1 is connected with a first electrically conductive member for connecting the second terminal of the connector 10 included in the electronic device 1 to the first terminal of the connector 20.

In addition, the second terminal of the connector 20 included in the electronic device 2 is connected with a second electrically conductive member for connecting the second terminal of the connector 30 included in the electronic device 3 to the second terminal of the connector 20.

Moreover, the third terminal of the connector 20 included in the electronic device 2 is connected with a third electrically conductive member for connecting the fourth terminal of the connector 10 included in the electronic device 1 to the third terminal of the connector 20.

Furthermore, the fourth terminal of the connector 20 included in the electronic device 2 is connected with a fourth electrically conductive member for connecting the third terminal of the connector 30 included in the electronic device 3 to the fourth terminal of the connector 20.

In this case, the first electrically conductive member corresponds to the first transition wiring line a21, and the second electrically conductive member corresponds to the first transition wiring line a31. In addition, the third electrically conductive member corresponds to the second transition wiring line a22, and the fourth electrically conductive member corresponds to the second transition wiring a32.

Figure 5:
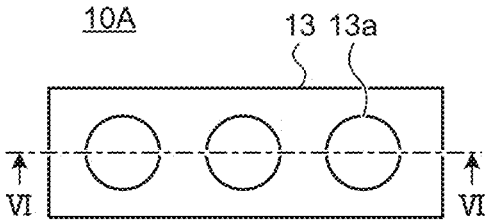
FIG. 5 is a diagram illustrating an example configuration of a connector according to a first variation of the embodiment of the present invention.
Figure 6:
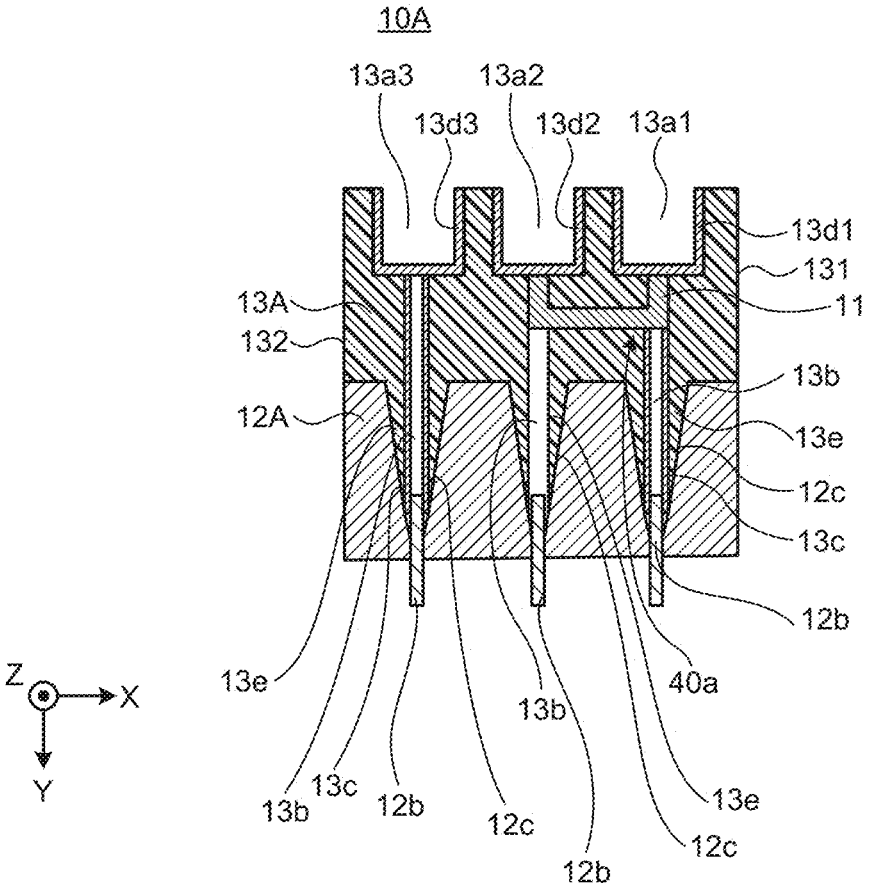
FIG. 6 is an arrow-directional cross-sectional view taken along a line VI-VI illustrated in FIG. 5.

FIG. 5 is a diagram illustrating an example configuration of a connector according to a first variation of the embodiment of the present invention. FIG. 6 is an arrow-directional cross-sectional view taken along a line VI-VI illustrated in FIG. 5. A connector 10A illustrated in FIG. 6 includes a first housing 12A and a second housing 13A in place of the first housing 12 and the second housing 13 illustrated in FIG. 4.

The first housing 12A has three through-holes 12*a* formed therein, and includes three terminals 12*b* and three recesses 12*c*. The first housing 12A has a width in the X-axis direction less than the width of the first housing 12 in the X-axis direction illustrated in FIG. 4.

The second housing 13A has three terminal insertion holes 13*a* formed therein. The second housing 13A also includes three terminals 13*d*, one conductor 11, two conductors 13*c*, and three protrusions 13*e*. The second housing 13A includes the conductors 13*c* respectively provided on the first and third protrusions 13*e* as viewed from the first end face 131 to the second end face 132. The conductor 13*c* provided on the third protrusion 13*e* has one end connected to the terminal 13*d*, and the other end connected to the terminal 12*b*. The second protrusion 13*e* has no conductor 13*c*. The second housing 13A has a width in the X-axis direction less than the width of the second housing 13 in the X-axis direction illustrated in FIG. 4.

As viewed from the first end face 131 to the second end face 132 of the second housing 13, the first-order terminal 13*d* is a first terminal, the second-order terminal 13*d* is a second terminal, and the third-order terminal 13*d* is a third terminal. The conductor 13*c* connected to the third terminal functions as a second connecting conductor intended to electrically connect the third terminal to the second device-side conductor provided in the electronic device.

The connector 10A can be connected with, for example, one transition wiring line that transmits a signal used in common by the multiple electronic devices 1, 2, and 3, and one transition wiring line that transmits a signal used only by a particular electronic device of the multiple electronic devices 1, 2, and 3. For example, the transition wiring line to transmit a signal used only by the electronic device 1 is connected to the third terminal. In the connector 10A, the number of the terminals 13*d* can be reduced, and therefore a structure of the connector 10A is simplified.

Similarly to the connector 10, the connector 10A can reduce the width of the connector 10A in the Z-axis direction. The connector 10A can also reduce its width in the X-axis direction as compared to the connector 10. For example, an electronic device system 100 configured to use only a single type of signal in common in the multiple electronic devices 1, 2, and 3 enables a reduction in the width of each of the multiple electronic devices 1, 2, and 3 illustrated in FIG. 1 in the X-axis direction. In this way, the connector 10A illustrated in FIG. 6 can be used with the multiple electronic devices 1, 2, and 3 each having a reduced width in the X-axis direction. Accordingly, the connector 10A can further reduce the size of the entire electronic device system 100. Note that the connector 20 and the connector 30 illustrated in FIG. 1 may each be configured similarly to the connector 10A illustrated in FIG. 6. In addition, for an electronic device system 100, for example, the connector 10 illustrated in FIG. 4, a connector 20 configured similarly to the connector 10A illustrated in FIG. 6, and a connector 30 configured similarly to the connector 10A illustrated in FIG. 6 may be combined together. Thus, even when multiple connectors having different shapes are used in combination, these connectors can each be connected with one transition wiring line that transmits a signal used in common by the multiple electronic devices 1, 2, and 3, and one transition wiring line that transmits a signal used only by a particular electronic device of the multiple electronic devices 1, 2, and 3.

Note that the second housing 13A can also be connected to the first housing 12 illustrated in FIG. 4. That is, the first housing 12 illustrated in FIG. 4 can be used with both the second housing 13 illustrated in FIG. 4 and the second housing 13A illustrated in FIG. 6.

Figure 7:
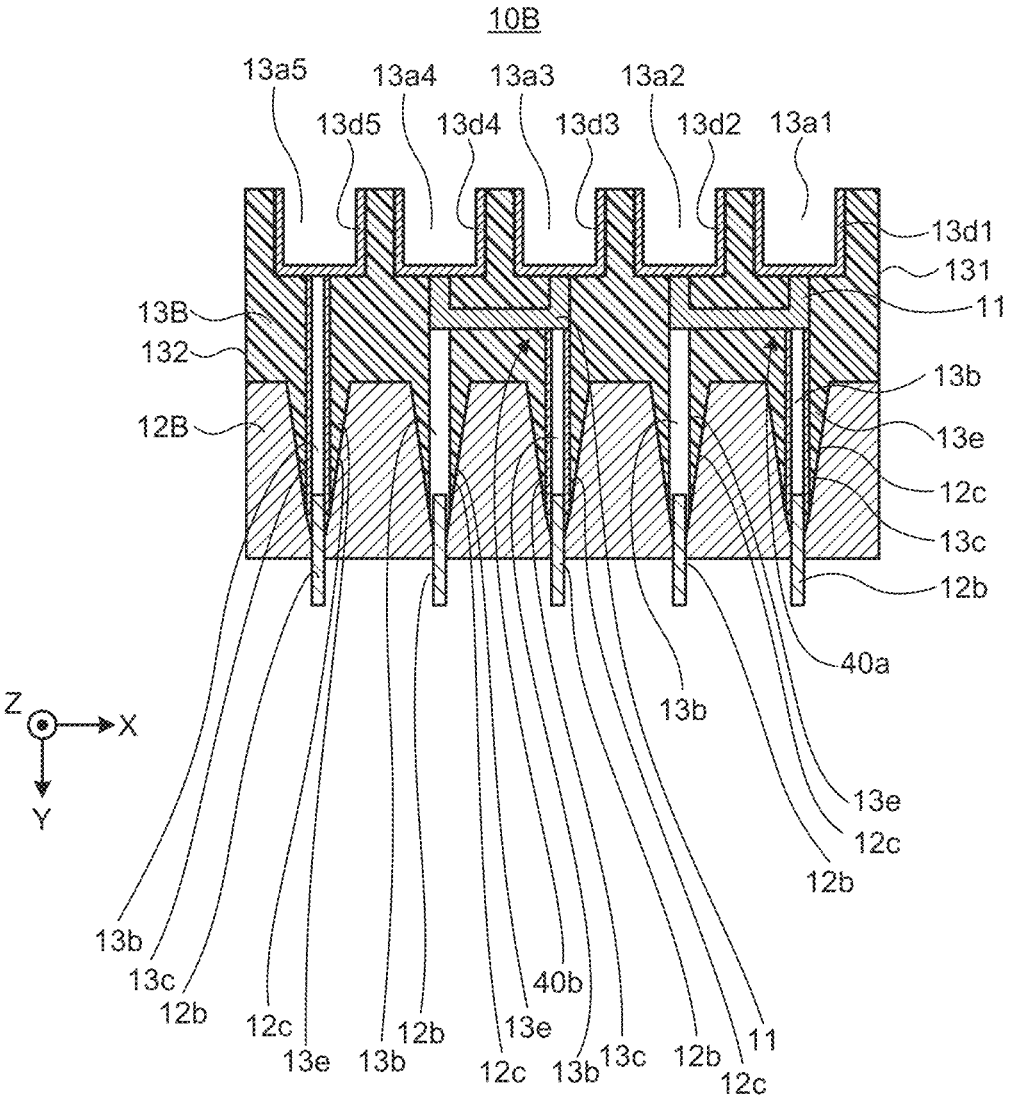
FIG. 7 is a cross-sectional view of a connector according to a second variation of the embodiment of the present invention.

FIG. 7 is a cross-sectional view of a connector according to a second variation of the embodiment of the present invention. A connector 10B illustrated in FIG. 7 includes a first housing 12B and a second housing 13B in place of the first housing 12 and the second housing 13 illustrated in FIG. 4.

The first housing 12B has five through-holes 12*a* formed therein, and includes five terminals 12*b* and five recesses 12*c*. The first housing 12B has a width in the X-axis direction less than the width of the first housing 12 in the X-axis direction illustrated in FIG. 4.

The second housing 13B has five terminal insertion holes 13*a* formed therein. The second housing 13B also includes five terminals 13*d*, two conductors 11, three conductors 13*c*, and five protrusions 13*e*. The second housing 13B has the conductors 13*c* respectively provided on the first, third, and fifth protrusions 13*e* as viewed from the first end face 131 to the second end face 132. The conductor 13*c* provided on the fifth protrusion 13*e* has one end connected to the terminal 13*d*, and another end connected to the terminal 12*h*. The second and fourth protrusions 13*e* have no conductor 13*c*. The second housing 13B has a width in the X-axis direction less than the width of the second housing 13 illustrated in FIG. 1 in the X-axis direction.

As viewed from the first end face 131 to the second end face 132 of the second housing 13, the first-order terminal 13*d* is a first terminal, the second-order terminal 13*d* is a second terminal, the third-order terminal 13*d* is a third terminal, the fourth-order terminal 13*d* is a fourth terminal, and the fifth-order terminal 13*d* is a fifth terminal. The conductor 13*c* connected to the fifth terminal functions as the third connecting conductor intended to electrically connect the fifth terminal to the third device-side conductor provided in the electronic device.

The connector 10B can be connected with, for example, two transition wiring lines that each transmit a signal used in common by the multiple electronic devices 1, 2, and 3, and one transition wiring line that transmits a signal used only by a particular electronic device of the multiple electronic devices 1, 2, and 3. For example, the transition wiring line that transmits a signal used only by the electronic device 1 is connected to the fifth terminal. In the connector 10B, the number of the terminals 13*d* can be reduced, and therefore a structure of the connector 10B is simplified. Note that the connector 20 and the connector 30 illustrated in FIG. 1 may each be configured similarly to the connector 10B illustrated in FIG. 7. In addition, in the electronic device system 100, for example, the connector 10 illustrated in FIG. 4, a connector 20 configured similarly to the connector 10B illustrated in FIG. 7, and a connector 30 configured similarly to the connector 10B illustrated in FIG. 7 may be combined together. Thus, even when multiple connectors having different shapes are used in combination, these connectors can be connected with two transition wiring lines that transmits a signal used in common by the multiple electronic devices 1, 2, and 3, and one transition wiring line that transmits a signal used only by a particular electronic device of the multiple electronic devices 1, 2, and 3.

Similarly to the connector 10, the connector 10B can reduce the width of the connector 10B in the Z-axis direction. The connector 10B can also reduce the width in the X-axis direction as compared to the connector 10. For example, an electronic device system 100 configured to use only two types of signals in common in the multiple electronic devices 1, 2, and 3 enables a reduction in the width in the X-axis direction of each of the multiple electronic devices 1, 2, and 3 illustrated in FIG. 1. In this way, the connector 10B illustrated in FIG. 7 can be used for the multiple electronic devices 1, 2, and 3 each having a smaller width in the X-axis direction. Accordingly, the connector 10B can further reduce the size of the entire electronic device system 100.

Note that the second housing 13B can also be connected to the first housing 12 illustrated in FIG. 4. That is, the first housing 12 illustrated in FIG. 4 can be used with both the second housing 13 illustrated in FIG. 4 and the second housing 13B illustrated in FIG. 7.

Figure 8:
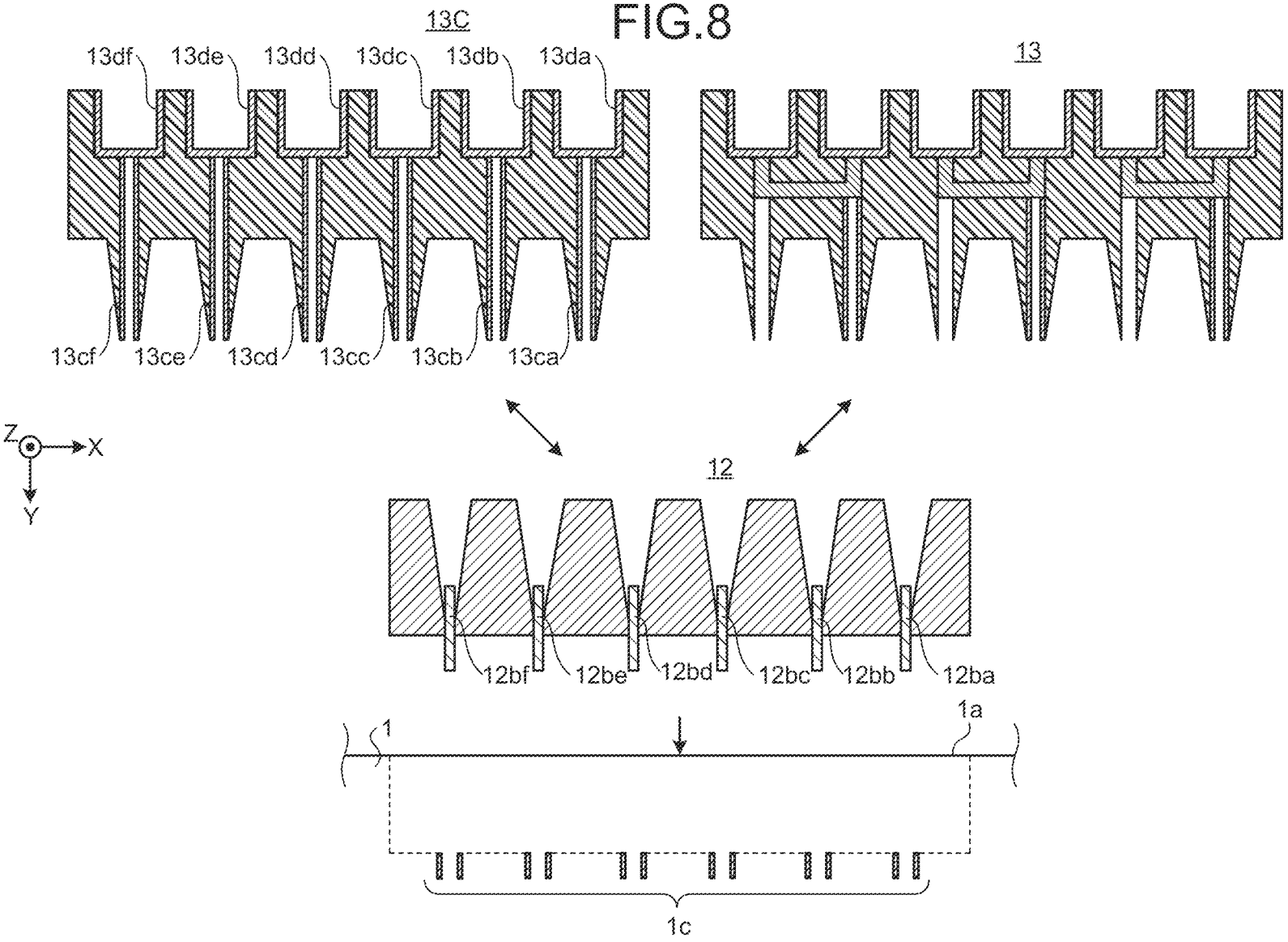
FIG. 8 is a diagram illustrating a situation in which the first housing illustrated in FIG. 4 is connected with a second housing that does not support a transition wiring line.

In addition, the first housing 12 illustrated in FIG. 4 can also be connected with a second housing that does not support any transition wiring line. FIG. 8 is a diagram illustrating a situation in which the first housing illustrated in FIG. 4 is connected with a second housing that does not support any transition wiring line. A second housing 13C illustrated in FIG. 8 is provided with six conductors 13*c* instead of the conductors 11. The second housing 13C is connected with, for example, transition wiring lines for transmitting a signal used only by a particular electronic device. The second housing 13C has a width in the Z-axis direction equal to the width of the second housing 13 in the Z-axis direction. Six conductors 13*ca*, 13*cb*, 13*cc*, 13*cd*, 13*ce*, and 13*cf* of the second housing 13C have their one ends connected to six terminals 13*da*, 13*db*, 13*dc*, 13*dd*, 13*de*, and 13*df* of the second housing 13C, respectively. In addition, the six conductors 13*ca*, 13*cb*, 13*cc*, 13*cd*, 13*ce*, and 13*cf* of the second housing 13C have their other ends connected to six terminals 12*ba*, 12*bb*, 12*bc*, 12*bd*, 12*be*, and 12*bf* of the first housing 12, respectively. The six terminals 12*ba*, 12*bb*, 12*bc*, 12*bd*, 12*be*, and 12*bf* are connected to six device-side conductors 1*ce*, 1*cb*, 1*cc*, 1*cd*, 1*ce*, and 1*cf*, respectively. Changing the housing connected to the first housing 12 from the second housing 13 to the second housing 13C enables exchanging between a configuration that supports transition wiring lines and another configuration that does not support any transition wiring lines without changing the size of a connector.

Although this embodiment provides electrical connection between a transition wiring line and an electronic device by way of insertion of the male terminal provided on the transition wiring line into the terminal insertion hole of the connector 10, 10A, or 10B, a manner of connecting a transition wiring line to the connector 10, 10A, or 10B may be based on a spring clamp, a screw clamp, soldering, or the like. It is also noted that in a case of use of a bus bar instead of the transition wiring lines, a configuration may be realized such that projecting-shaped electrically conductive terminals are provided on the connectors 10, 10A, or 10B instead of the terminals 13*d*, and terminals formed on the bus bar are connected to these projecting-shaped electrically conductive terminals.

Note that although this embodiment assumes that the enclosure of each of the connectors 10, 10A, and 10B is constituted by two separable housings, the enclosure of each of the connectors 10, 10A, and 10B may be constructed of a single housing.

In addition, although the connectors 10, 10A, and 10B have been described with the assumption that the protrusions 13*e* are fit in the recesses 12*c*, it is sufficient that the conductors 11, the conductors 13*c*, and the terminals 12*b* are configured to be electrically connected to each other, and the configuration of each of the connectors 10, 10A, and 10B is not necessarily limited to the illustrated examples. For example, the second housing 13 is not provided with a protrusion 13*e* and the region on the first housing 12 side of the second housing 13 is made flat, and the first housing 12 is not provided with a recess 12*c*, and the region on the second housing 13 side of the first housing 12 is made flat. Then, a hook-shaped member is formed on each of the first end face 131 and the second end face 132 of the second housing 13 to allow the two hook-shaped members to extend from the second housing 13 toward the first housing 12 with leading ends of the two hook-shaped members getting stuck in recesses formed in the first housing 12. This enables the second housing 13 to be fixed to the first housing 12.

Moreover, the connectors 10, 10A, and 10B are not provided with a cylindrical terminal 13*c* between the terminal 12*b* provided correspondingly to the second terminal 13*d* and the conductor 11 in the region facing the electronic device side. In this manner, the structures of the connectors 10, 10A, and 10B are simplified as compared to when the cylindrical terminal 13*c* is provided between the terminal 12*b* provided correspondingly to the second terminal 13*d* and the conductor 11, and at the same time a manufacturing cost of the connectors 10, 10A, and 10B can be reduced. Note that the connectors 10, 10A, and 10B may also be configured not to include, in the region facing the electronic device side, the cylindrical terminal 13*c* between the terminal 12*b* provided correspondingly to the first terminal 13*d* and the conductor 11, but to include the cylindrical terminal 13*c* between the terminal 12*b* provided correspondingly to the second terminal 13*d* and the conductor 11.

Furthermore, although the connectors 10, 10A, and 10B use the cylindrical terminals 13*c*, the shape of the terminal 13*c* may not be limited to a hollow-cylindrical shape, but may also be a solid bar shape. In a case of use of solid bar-shaped terminals 13*c*, a tip of the terminal 12*b* is connected to a tip of the terminal 13*c*.

The configurations described in the foregoing embodiment are merely examples of contents of the present invention, and can each be combined with other publicly known techniques and partially omitted and/or modified without departing from the scope of the present invention.

REFERENCE SIGNS LIST

1, 2, 3 electronic device; 1*a*, 2*a*, 3*a* end face; 1*b*, 2*b*, 3*b* connector insertion opening; 1*c*, 1*ca*, 1*cb*, 1*cc*, 1*cd*, 1*ce*, 1*cf*, 2*c*, 3*c* device-side conductor; 1*d* internal wiring line; 1*e* internal circuit; 10, 10A, 10B, 20, 30 connector; 11, 13*c*,

13*ca*, 13*cb*, 13*cc*, 13*cd*, 13*ce*, 13*cf*, 21, conductor; 12, 12A, 12B first housing; 12*a*, 13*b* through-hole; 12*b*, 12*ba*, 12*bb*, 12*bc*, 12*bd*, 12*be*, 12*bf*, 13*d*, 13*d*1, 13*d*2, 13*d*3, 13*d*4, 13*d*5, 13*d*6, 13*d*a, 13*db*, 13*dc*, 13*dd*, 13*de*, 13*df* terminal; 12*c* recess; 13, 13A, 135, 13C, 23, 33 second housing; 13*a*, 13*a*1, 13*a*2, 13*a*3, 13*a*4, 13*a*5, 13*a*6, 23*a*, 33*a* terminal insertion hole; 13*e* protrusion; 40*a* first connecting conductor; 40*b* second connecting conductor; 40*c* third connecting conductor; 100 electronic device system; 131, 231, 331 first end face; 132, 232, 332 second end face; a1, a2, a3 transition wiring line.

The invention claimed is:

1. A connector comprising:

a first housing to be attached to an electronic device;

a second housing attached to the first housing on a side opposite to the electronic device;

a first terminal disposed in a region of the second housing located on a side of the second housing opposite to a region facing the electronic device;

a second terminal disposed in the region of the second housing located on the side of the second housing opposite to the region facing the electronic device and disposed adjacent to the first terminal;

a third terminal disposed in the region of the second housing located on the side of the second housing opposite to the region facing the electronic device and disposed adjacent to the second terminal along an arrangement direction of the first terminal and the second terminal; and a first connecting conductor to electrically connect together the first terminal and the second terminal, and electrically connect the first terminal and the second terminal to one of first device-side conductors provided in the electronic device, wherein the first connecting conductor includes:

a first conductor disposed in the region located on the opposite side to electrically connect together the first terminal and the second terminal;

a first connecting terminal having one end connected to the first conductor, and another end extending toward a region facing the electronic device;

a first bar-shaped terminal provided correspondingly to the first terminal in a region facing the electronic device, the first bar-shaped terminal having one end connected to the first connecting terminal and another end electrically connected to the one of the first device-side conductors; and a second bar-shaped terminal provided correspondingly to the second terminal in the region facing the electronic device, and electrically connected to another one of the first device-side conductors, and the second bar-shaped terminal and the first conductor are not electrically connected to each other.

2. The connector according to claim 1, comprising:

a fourth terminal disposed in the region located on the opposite side and disposed adjacent to the third terminal along the arrangement direction; and a second connecting conductor to electrically connect together the third terminal and the fourth terminal, and electrically connect the third terminal and the fourth terminal to one of second device-side conductors provided in the electronic device, wherein the second connecting conductor includes:

a second conductor disposed in the region located on the opposite side to electrically connect together the third terminal and the fourth terminal;

a second connecting terminal having one end connected to the second conductor, and another end extending toward a region facing the electronic device;

a third bar-shaped terminal provided correspondingly to the third terminal in a region facing the electronic device, the third bar-shaped terminal having one end connected to the second connecting terminal and another end electrically connected to the one of the second device-side conductors; and a fourth bar-shaped terminal provided correspondingly to the fourth terminal in the region facing the electronic device, and electrically connected to another one of the second device-side conductors, and the fourth bar-shaped terminal and the second conductor are not electrically connected to each other.

3. The connector according to claim 1, comprising:

a second connecting conductor to electrically connect the third terminal to a second device-side conductor provided in the electronic device.

4. The connector according to claim 2, comprising:

a fifth terminal disposed in the region located on the opposite side and disposed adjacent to the fourth terminal along the arrangement direction; and a third connecting conductor to electrically connect the fifth terminal to a third device-side conductor provided in the electronic device.

5. A connector comprising:

a first housing to be attached to an electronic device;

a second housing attached to the first housing on a side opposite to the electronic device;

a first terminal disposed in a region of the second housing located on a side of the second housing opposite to a region facing the electronic device;

a second terminal disposed in the region of the second housing located on the side of the second housing opposite to the region facing the electronic device and disposed adjacent to the first terminal;

a third terminal disposed in the region of the second housing located on the side of the second housing opposite to the region facing the electronic device and disposed adjacent to the second terminal along an arrangement direction of the first terminal and the second terminal; and a first connecting conductor to electrically connect together the first terminal and the second terminal, and electrically connect the first terminal and the second terminal to a first device-side conductor provided in the electronic device, wherein the first connecting conductor includes:

a conductor disposed in the region located on the opposite side to electrically connect together the first terminal and the second terminal;

a terminal having one end connected to the conductor, and another end extending toward a region facing the electronic device; and a first bar-shaped terminal provided correspondingly to the second terminal in a region facing the electronic device, the first bar-shaped terminal having one end connected to the terminal and another end electrically connected to the first device-side conductor, and the terminal is not provided between a second bar-shaped terminal provided correspondingly to the first terminal in the region facing the electronic device and the conductor.

6. An electronic device system comprising:

a first electronic device including the connector according to claim 1 as a first connector;

a second electronic device including the connector according to claim 1 as a second connector, and disposed adjacent to the first electronic device;

a third electronic device including the connector according to claim 1 as a third connector, and disposed on a side of the second electronic device opposite to the first electronic device;

a first electrically conductive member to connect together the second terminal of the first connector and the first terminal of the second connector; and a second electrically conductive member to connect together the second terminal of the second connector and the first terminal of the third connector.

7. An electronic device system comprising:

a first electronic device including the connector according to claim 5 as a first connector;

a second electronic device including the connector according to claim 5 as a second connector, and disposed adjacent to the first electronic device;

a third electronic device including the connector according to claim 5 as a third connector, and disposed on a side of the second electronic device opposite to the first electronic device;

a first electrically conductive member to connect together the first terminal of the first connector and the second terminal of the second connector; and a second electrically conductive member to connect together the first terminal of the second connector and the second terminal of the third connector.

8. A connector comprising:

a housing;

a first external terminal;

a second external terminal disposed adjacent to the first external terminal;

a third external terminal disposed adjacent to the second external terminal along an arrangement direction of the first external terminal and the second external terminal;

a fourth external terminal disposed adjacent to the third external terminal along the arrangement direction of the first external terminal and the second external terminal;

a first conductor to electrically connect together the first external terminal and the second external terminal;

a second conductor to electrically connect together the third external terminal and the fourth external terminal;

a first internal terminal provided correspondingly to the first external terminal;

a second internal terminal provided correspondingly to the second external terminal and disposed adjacent to the first internal terminal;

a third internal terminal provided correspondingly to the third external terminal and disposed adjacent to the second internal terminal;

a fourth internal terminal provided correspondingly to the fourth external terminal and disposed adjacent to the third internal terminal;

a first connecting conductor to electrically connect together the first conductor and the first internal terminal; and a second connecting conductor to electrically connect together the second conductor and the third internal terminal, wherein the second internal terminal is not electrically connected to the first conductor or the second conductor, and the fourth internal terminal is not electrically connected to the first conductor or the second conductor.

* * * * *